US006254364B1

(12) United States Patent
Onishi et al.

(10) Patent No.: US 6,254,364 B1
(45) Date of Patent: Jul. 3, 2001

(54) HIGH-PRESSURE FUEL SUPPLY ASSEMBLY

(75) Inventors: Yoshihiko Onishi; Shoichiro Nishitani, both of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/481,938

(22) Filed: Jan. 13, 2000

(30) Foreign Application Priority Data

Sep. 10, 1999 (JP) ..... 11-257552

(51) Int. Cl.[7] ..... F04B 11/00

(52) U.S. Cl. ..... 417/540; 417/542; 138/26; 138/31

(58) Field of Search ..... 417/540, 542; 138/26, 31, 30; 123/184.57

(56) References Cited

U.S. PATENT DOCUMENTS 6,053,208 * 4/2000 Onishi et al. ..... 138/30
6,053,712 * 4/2000 Konishi et al. ..... 417/540
6,062,830 * 5/2000 Kikuchi et al. ..... 417/540
6,062,831 * 5/2000 Konishi et al. ..... 417/540
6,079,450 * 6/2000 Onishi et al. ..... 138/30
6,095,774 * 8/2000 Tanaka et al. ..... 417/540
6,135,734 * 10/2000 Isozumi et al. ..... 417/542

FOREIGN PATENT DOCUMENTS 10-77927 3/1998 (JP) .

* cited by examiner

*Primary Examiner*—Cheryl J. Tyler
(74) *Attorney, Agent, or Firm*—Sughrue, Mion, Zinn, Macpeak & Seas, PLLC

(57) ABSTRACT

A high-pressure fuel supply assembly includes a first member composed stainless steel and a second member composed of plated low-carbon steel in at least one weld portion among a low-pressure damper weld portion, a high-pressure fuel pump weld portion, and a high-pressure regulator weld portion.

9 Claims, 8 Drawing Sheets

HIGH-PRESSURE FUEL SUPPLY ASSEMBLY

BACKGROUND OF THE INVENTION

1. Field of the Invention

The present invention relates to a high-pressure fuel supply assembly used in a cylinder-injected engine, for example.

2. Description of the Related Art

FIG. 6 is a block diagram showing a construction of a conventional high-pressure fuel supply assembly 100, FIG. 7 is a partially removed cross section of the high-pressure fuel supply assembly 100, FIG. 8 is a front elevation of the low-pressure damper 5 in FIG. 7, and FIG. 9 is a cross section of the high-pressure regulator 10 in FIG. 7.

This high-pressure fuel supply assembly 100 includes: a low-pressure damper 5 through which flows low-pressure fuel conveyed by a low-pressure fuel pump 2 within a fuel tank 1, the low-pressure damper 5 being connected to a low-pressure fuel intake passage 3; a high-pressure fuel pump 6 for pressurizing low-pressure fuel from the low-pressure damper 5 and discharging it into a high-pressure fuel discharge passage 7; a high-pressure damper 8 for absorbing surges in the high-pressure fuel flowing through the high-pressure fuel discharge passage 7; and a high-pressure regulator 10 for adjusting the pressure of the high-pressure fuel to a predetermined pressure, the high-pressure regulator 10 being disposed in a side passage 9 branching from the high-pressure fuel discharge passage 7.

Moreover, reference numeral 4 is a low-pressure regulator mounted in a passage branching from the low-pressure fuel intake passage 3, numeral 12 are filters, numeral 13 are check valves, numeral 14 is a drainage passage returning fuel from the high-pressure fuel pump 6 to the fuel tank 1, numeral 15 are delivery pipes connected to the high-pressure fuel discharge passage 7, and numeral 16 are fuel injection valves mounted on the delivery pipes 15.

The above low-pressure damper 5 is mounted in a first recess 50*a* in a casing 50. The low-pressure damper 5 includes: a cylindrical stainless-steel holder 51; a stainless-steel base 54 having a ball 53 disposed in a bore 52; and a stainless-steel bellows 55 disposed inside the holder 51.

The above high-pressure fuel pump 6 includes: a valve assembly 20 for opening and closing the low-pressure fuel intake passage 3 and the high-pressure fuel discharge passage 7; and a high-pressure fuel supply body 21 for pressurizing low-pressure fuel and discharging it into the high-pressure fuel discharge passage 7.

FIG. 10 is a cross section of the valve assembly 20, the valve assembly 20 being composed of: a first plate 22; a second plate 23; and a thin, flat valve main body 19 positioned between the first and second plates 22 and 23. A first fuel inlet 24 connected to the low-pressure fuel intake passage 3 and a first fuel outlet 25 connected to the high-pressure fuel discharge passage 7 are formed in the first plate 22, the inside dimensions of the first fuel outlet 25 being larger than the inside dimensions of the first fuel inlet 24. A second fuel inlet 26 having inside dimensions larger than those of the first fuel inlet 24 and a second fuel outlet 27 having inside dimensions smaller than those of the first fuel outlet 25 are formed in the second plate 23. The valve main body 19 is provided with: an intake-side tongue 28 interposed between the first fuel inlet 24 and the second fuel inlet 26; and a discharge-side tongue 29 interposed between the first fuel outlet 25 and the second fuel outlet 27.

The high-pressure fuel supply body 21 includes: an aluminum casing 50 housing the valve assembly 20 inside a second recess 50*b;* a cylindrical sleeve 30 housed in surface contact with the second plate 23 of the valve assembly 20; a piston 33 slidably inserted inside the sleeve 30 forming a fuel pressurization chamber 32 in cooperation with the sleeve 30; and a first spring 36 disposed between a recessed bottom surface 34 of the piston 33 and a holder 35, the spring 36 applying force to the piston 33 in a direction which expands the volume of the fuel pressurization chamber 32.

The high-pressure fuel supply body 21 also includes: a housing 37 fitted over the sleeve 30; a ring-shaped securing member 38 securing the valve assembly 20, the sleeve 30, and the housing 37 inside the second recess 50*b* of the casing 50 by fitting over the housing 37 and engaging the second recess 50*b* of the casing 50 by means of a male thread portion formed on an outer circumferential surface of the securing member 38; a stainless-steel bellows 40 disposed between the housing 37 and a receiving portion 39 secured to a tip portion of the piston 33; a second spring 41 compressed and disposed around the outside of the bellows 40 between the housing 37 and a holder 42; and a bracket 43 disposed to surround the second spring 41, the bracket 43 being secured to the casing 50 by a bolt (not shown).

The high-pressure fuel supply body 21 also includes: a tappet 44 slidably disposed in a slide bore 43*a* in an end portion of the bracket 43; a pin 45 rotatably suspended in the tappet 44; a bush 46 rotatably disposed on the pin 45; and a cam roller 47 rotatably disposed on the bush 46, the cam roller 47 contacting a cam (not shown) secured to a cam shaft (not shown), following the shape thereof, and reciprocating the piston 33.

The high-pressure regulator 10 is disposed inside a third recess 50*c* in the casing 50. The high-pressure regulator 10 includes: a valve 80 reciprocating axially; a holder 81 disposed opposite the valve 80; an adjusting screw 82 for determining the axial position of the holder 81, a tip of the screw contacting the holder 81; a spring 83 compressed and disposed between the valve 80 and the holder 81; a pipe 84 surrounding the holder 81 and a portion of the valve 80; a stainless-steel valve seat 85 formed with a passage 86 in which the valve 80 reciprocates; and a plate 87 forming a volume chamber 88 for damping the valve 80, the plate 87 being joined to the valve seat 85 by welding. Moreover, the valve seat 85 is secured inside the third recess 50*c* at the entrance to the third recess 50*c* by means of the pipe 84, and a securing thread 89 is engaged at a central portion by the adjusting screw 82 which moves inwards and outwards axially.

In a high-pressure fuel supply assembly 100 having the above construction, the piston 33 is reciprocated by the rotation of the cam secured to the cam shaft of an engine (not shown) by means of the cam roller 47, the bush 46, the pin 45, and the tappet 44.

When the piston 33 is descending (during the fuel intake stroke), the volume of the inside of the fuel pressurization chamber 32 increases and the pressure inside the fuel pressurization chamber 32 decreases, and when the pressure inside the fuel pressurization chamber 32 becomes lower than the pressure in the first fuel inlet 24, the intake-side tongue 28 of the valve main body 19 bends towards the second fuel inlet 26, allowing fuel in the low-pressure fuel supply passage 1 to flow through the first fuel inlet 24 into the fuel pressurization chamber 32.

When the piston 33 is ascending (during the fuel discharge stroke), the pressure inside the fuel pressurization chamber 32 increases, and when the pressure inside the fuel pressurization chamber 32 becomes greater than the pressure in the first fuel outlet 25, the discharge-side tongue 29 of the valve main body 19 bends towards the first fuel outlet 25, allowing fuel in the fuel pressurization chamber 32 to flow through the first fuel outlet 25 and the fuel discharge passage 7 into the high-pressure damper 8, where fuel pressure surges are absorbed. High-pressure fuel is then supplied to the check valve 13 and the delivery pipes 15, and thereafter supplied to the fuel injection valves 16, which inject fuel into each of the cylinders (not shown) of the engine.

Moreover, after the high-pressure fuel has left the check valve 13, it enters the high-pressure regulator 10 through an inlet 90, and enters the interior of the valve seat 85 through an entrance 91 in the valve seat 85. When, the pressure of the fuel is above a predetermined pressure, the valve 80 is moved in opposition to the elastic force of the spring 83 and is separated from the valve seat, some of the fuel flowing through an outlet 93 and an overflow port 94 into the drainage passage 92 and returning to the fuel tank. In other words, high-pressure fuel above the predetermined pressure is not supplied to the delivery pipes 15. This fuel pressure is set by adjusting the position of the holder 81 by moving the adjusting screw 82 inwards or outwards.

Furthermore, fuel leaking out from between the piston 33 and the sleeve 30 is returned to the fuel tank 1 through the inside of the bellows 40 and the drainage passage 14.

In a high-pressure fuel supply assembly 100 of the above construction, a low-pressure damper weld portion A is formed where the holder 51 of the low-pressure damper 5 contacts the base 54, and high-pressure fuel pump weld portions B and C are formed where the bellows 40 contacts the housing 37 and the receiving portion 39, respectively. A high-pressure regulator weld portion D is formed where the plate 87 contacts the valve seat 85. It is necessary to ensure a good seal and resistance to corrosion at these weld portions A, B, C, and D, and for that reason the holder 51, the base 54, the bellows 55, the housing 37, the receiving portion 39, the bellows 40, the plate 87, and the valve seat 85 are all made of stainless steel.

However, although stainless steel has good corrosion resistance, it is an expensive material and is difficult to process, and therefore one problem has been that manufacturing costs have been high.

Furthermore, FIG. 11 is an enlargement of the conventional low-pressure damper weld portion A, and because tensile forces arise in this weld portion A in the direction of the arrows E due to thermal contraction during welding, another problem has been that cracks form easily.

SUMMARY OF THE INVENTION

The present invention aims to solve the above problems and an object of the present invention is to provide a high-pressure fuel supply assembly enabling material costs to be minimized and manufacturing costs to be reduced by improving workability, and ensuring good corrosion resistance.

Another object of the present invention is to provide a high-pressure fuel supply assembly reducing the likelihood of the formation of cracks at a weld portion.

To this end, according to the present invention, there is provided a high-pressure fuel supply assembly comprising: a low-pressure damper for absorbing surges in fuel flowing in from a fuel tank, the low-pressure damper including a low-pressure damper weld portion forming a seal between a first member and a second member which are contacted by the fuel; a high-pressure fuel pump for pressurizing fuel from the low-pressure damper and discharging the fuel into a high-pressure fuel discharge passage, the high-pressure fuel pump being connected to the low-pressure damper by means of a low-pressure fuel intake passage, and the high-pressure fuel pump including a high-pressure fuel pump weld portion forming a seal between a first member and a second member which are contacted by the fuel; and a high-pressure regulator for adjusting the pressure of the high-pressure fuel from the high-pressure fuel pump to a predetermined pressure, the high-pressure regulator including a high-pressure regulator weld portion forming a seal between a first member and a second member which are contacted by the fuel, the first member being composed stainless steel and the second member being composed of plated low-carbon steel in at least one weld portion among the low-pressure damper weld portion, the high-pressure fuel pump weld portion, and the high-pressure regulator weld portion.

DETAILED DESCRIPTION OF THE PREFERRED EMBODIMENT

A high-pressure fuel supply assembly 200 according to the present invention will be explained below, and parts the same as or corresponding to those in FIGS. 6 to 11 above will be given the same numbering.

Embodiment 1

Figure 1:
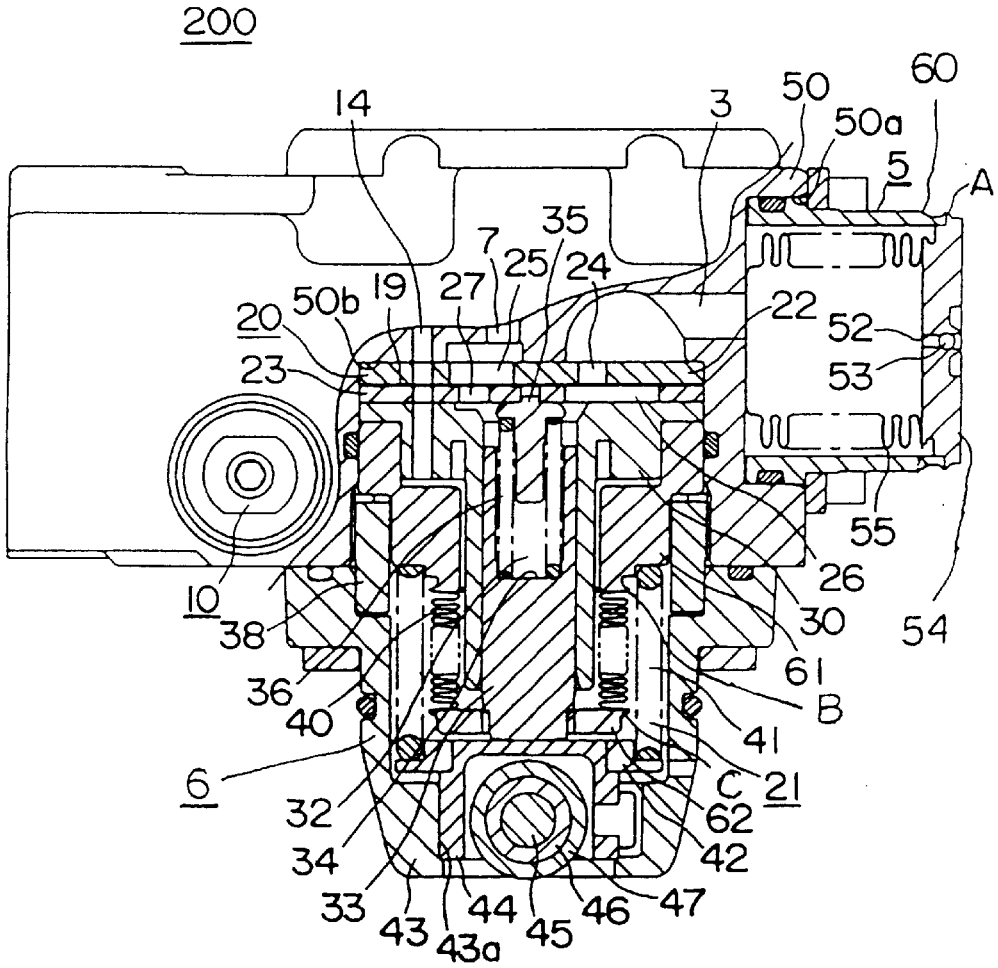
FIG. 1 is a cross section of a high-pressure fuel supply assembly according to Embodiment 1 of the present invention.
Figure 2:
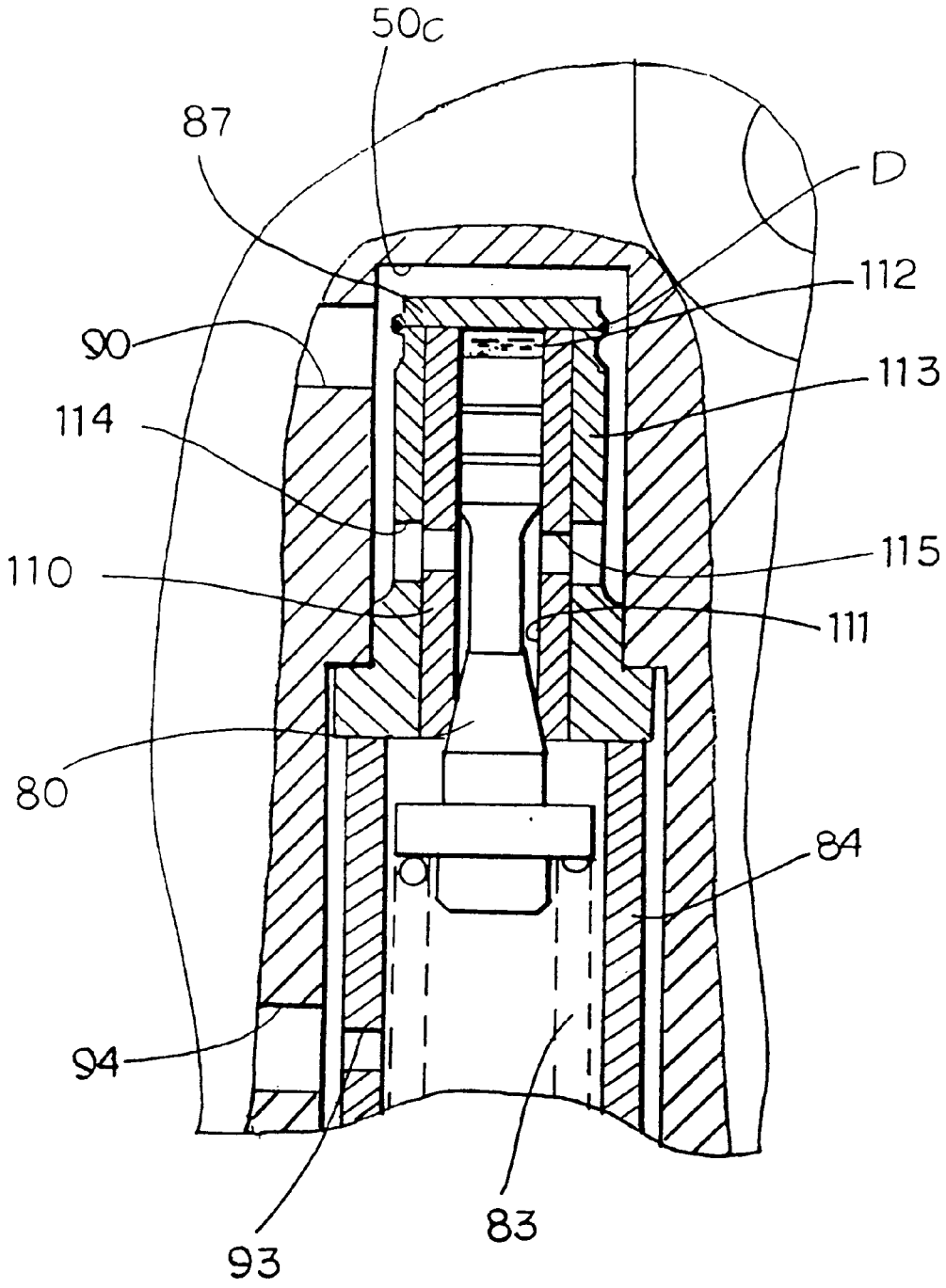
FIG. 2 is a partial cross section of the high-pressure regulator in FIG. 1.

FIG. 1 is a cross section of a high-pressure fuel supply assembly 200 according to Embodiment 1 of the present invention. This high-pressure fuel supply assembly 200 includes: a low-pressure damper 5 through which flows low pressure fuel conveyed by a low-pressure fuel pump 2 within a fuel tank 1, the low-pressure damper 5 being connected to a low-pressure fuel intake passage 3; a high-pressure fuel pump 6 for pressurizing low-pressure fuel from the low-pressure damper 5 and discharging it into a high-pressure fuel discharge passage 7; a high-pressure damper 8 for absorbing surges in the high-pressure fuel flowing through the high-pressure fuel discharge passage 7; and a high-pressure regulator 10 for adjusting the pressure of the high-pressure fuel to a predetermined pressure, the high-pressure regulator 10 being disposed in a side passage 9 branching from the high-pressure fuel discharge passage 7.

The above low-pressure damper 5 is mounted in a first recess 50*a* in a casing 50. The low-pressure damper 5 includes: a cylindrical holder 60 being a second member composed of low-carbon steel plated with nickel by electroplating, for example; a base 54 being a first member composed of stainless steel having a ball 53 disposed in a bore 52; and a metal bellows 55 composed of stainless steel welded to the base 54 to form a damper chamber.

The above high-pressure fuel pump 6 includes: a valve assembly 20 for opening and closing the low-pressure fuel intake passage 3 and the high-pressure fuel discharge passage 7; and a high-pressure fuel supply body 21 for pressurizing low-pressure fuel and discharging it into the high-pressure fuel discharge passage 7.

The valve assembly 20 is composed of: a first plate 22; a second plate 23; and a thin, flat valve main body 19 positioned between the first and second plates 22 and 23. A first fuel inlet 24 connected to the low-pressure fuel intake passage 3 and a first fuel outlet 25 connected to the high-pressure fuel discharge passage 7 are formed in the first plate 22, the inside dimensions of the first fuel outlet 25 being larger than the inside dimensions of the first fuel inlet 24. A second fuel inlet 26 having inside dimensions larger than those of the first fuel inlet 24 and a second fuel outlet 27 having inside dimensions smaller than those of the first fuel outlet 25 are formed in the second plate 23. The valve main body 19 is provided with: an intake-side tongue 28 interposed between the first fuel inlet 24 and the second fuel inlet 26; and a discharge-side tongue 29 interposed between the first fuel outlet 25 and the second fuel outlet 27.

The high-pressure fuel supply body 21 includes: an aluminum casing 50 housing the valve assembly 20 inside a second recess 50*b;* a cylindrical sleeve 30 housed in surface contact with the second plate 23 of the valve assembly 20; a piston 33 slidably inserted inside the sleeve 30 forming a fuel pressurization chamber 32 in cooperation with the sleeve 30; and a first spring 36 disposed between a recessed bottom surface 34 of the piston 33 and a holder 35, the spring 36 applying force to the piston 33 in a direction which expands the volume of the fuel pressurization chamber 32.

The high-pressure fuel supply body 21 also includes: a housing 61 being a second member fitted over the sleeve 30; a ring-shaped securing member 38 securing the valve assembly 20, the sleeve 30, and the housing 61 inside the second recess 50*b* of the casing 50 by fitting over the housing 61 and engaging the second recess 50*b* of the casing 50 by means of a male thread portion formed on an outer circumferential surface of the securing member 38; a bellows 40 being a first member disposed between the housing 61 and a receiving portion 62 being a second member secured to an end portion of the piston 33; a second spring 41 compressed and disposed between the housing 61 and a holder 42 around the outside of the bellows 40; and a bracket 43 disposed to surround the second spring 41, the bracket 43 being secured to the casing 50 by a bolt (not shown). The bellows 40, which is a first member, is composed of stainless steel, and the housing 61 and the receiving portion 62, which are second members, are composed of low-carbon steel plated with nickel by electroplating, for example.

The high-pressure fuel supply body 21 also includes: a tappet 44 slidably disposed in a slide bore 43*a* in an end portion of the bracket 43; a pin 45 rotatably suspended in the tappet 44; a bush 46 rotatably disposed on the pin 45; and a cam roller 47 rotatably disposed on bush 46, the cam roller 47 contacting a cam (not shown) secured to a cam shaft (not shown), following the shape thereof, and reciprocating the piston 33.

The high-pressure regulator 10 is disposed inside a third recess 50*c* in the casing 50. The high-pressure regulator 10 includes: a valve 80 reciprocating axially; a holder 81 disposed opposite the valve 80; an adjusting screw 82 for determining the axial position of the holder 81, a tip of the screw contacting the holder 81; a spring 83 compressed and disposed between the valve 80 and the holder 81; a pipe 84 surrounding the holder 81 and a portion of the valve 80; a stainless-steel valve seat 110 formed with a passage 111 in which the valve 80 reciprocates; a sleeve 113 integrally disposed with the valve seat 110 around the outer circumference of the valve seat 110; and a plate 87 forming a volume chamber 112 for damping the valve 80, the plate 87 being joined to the valve seat 110 and the sleeve 113 by welding. The plate 87, which is a first member, is composed of stainless steel, and the sleeve 113, which is a second member, is composed of low-carbon steel plated with nickel by electroplating, for example.

In a high-pressure fuel supply assembly 200 having the above construction, the piston 33 is reciprocated by the rotation of the cam secured to the cam shaft of an engine (not shown) by means of the cam roller 47, the bush 46, the pin 45, and the tappet 44.

When the piston 33 is descending (during the fuel intake stroke), the volume of the inside of the fuel pressurization chamber 32 increases and the pressure inside the fuel pressurization chamber 32 decreases, and when the pressure inside the fuel pressurization chamber 32 becomes lower than the pressure in the first fuel inlet 24, the intake-side tongue 28 of the valve main body 19 bends towards the second fuel inlet 26, allowing fuel in the low-pressure fuel supply passage 1 to flow through the first fuel inlet 24 into the fuel pressurization chamber 32.

When the piston 33 is ascending (during the fuel discharge stroke), the pressure inside the fuel pressurization chamber 32 increases, and when the pressure inside the fuel pressurization chamber 32 becomes greater than the pressure in the first fuel outlet 25, the discharge-side tongue 29 of the valve main body 19 bends towards the first fuel outlet 25, allowing fuel in the fuel pressurization chamber 32 to flow through the first fuel outlet 25 and the fuel discharge passage 7 into the high-pressure damper 8, where fuel pressure surges are absorbed. High-pressure fuel is then supplied to the check valve 13 and the delivery pipes 15, and thereafter supplied to the fuel injection valves 16, which inject fuel into each of the cylinders (not shown) of the engine.

Moreover, after the high-pressure fuel has left the check valve 13, it enters the high-pressure regulator 10 through an inlet 90, and enters the interior of the valve seat 110 through an entrance 114 in the sleeve 113 and an entrance 115 in the valve seat 110. When, the pressure of the fuel is above a predetermined pressure, the valve 80 is moved in opposition to the elastic force of the spring 83 and is separated from the valve seat, some of the fuel flowing through an outlet 93 and an overflow port 94 into the drainage passage 92 and returning to the fuel tank. In other words, high-pressure fuel above predetermined pressure is not supplied to the delivery pipes 15.

In a low-pressure damper 5 in a high-pressure fuel supply assembly 200 having the above construction, a low-pressure damper weld portion A is formed by welding and securing the holder 60 and the base 54 where the holder 60 contacts the base 54.

In the high-pressure fuel pump 6, high-pressure fuel pump weld portions B and C are formed by welding and securing the bellows 40, the housing 61, and the receiving portion 62 where the bellows 40 contacts the housing 61 and the receiving portion 62, respectively.

In the high-pressure regulator 10, a high-pressure regulator weld portion D is formed by welding and securing the plate 87 and the valve seat 113 where the plate 87 contacts the valve seat 113.

The base 54 of the low-pressure damper 5, the bellows 40 of the high-pressure fuel pump 6, and the plate 87 of the high-pressure regulator 10, which are first members, are composed of stainless steel because of its resilience and workability. The holder 60 of the low-pressure damper 5, the housing 61 and the receiving portion 62 of the high-pressure fuel pump 6, and the sleeve 113 of the high-pressure regulator 10, which are second members, are composed of low-carbon steel plated with nickel by electroplating, for example, in order to achieve cost reductions, workability by forging, and corrosion resistance. The reason that electroplating is used here instead of electroless plating is to prevent reducing agents, such as phosphorus or boron, from infiltrating the weld and causing cracks as they do in electroless plating.

Corrosion resistance is ensured because the chrome contained in the stainless steel is fused in the low-pressure damper weld portion A, the high-pressure fuel pump weld portions B and C, and the high-pressure regulator weld portion D, where each of the members are fused. Furthermore, because austenite and ferrite are produced by the fusion of nickel and chrome in the weld portions A, B, C, and D, cracks due to thermal contraction are prevented and the weld is stabilized.

Figure 5:
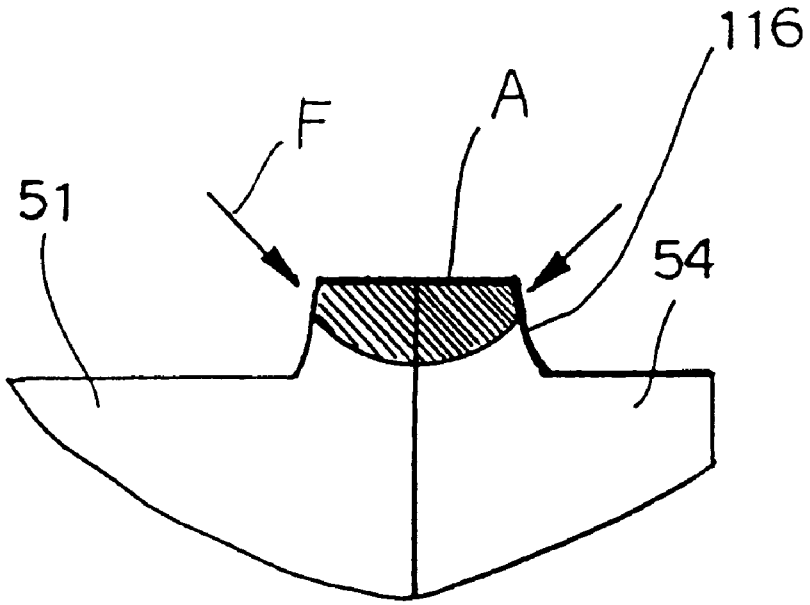
FIG. 5 is a cross section of the low-pressure damper weld portion in FIG. 1.
Figure 6:
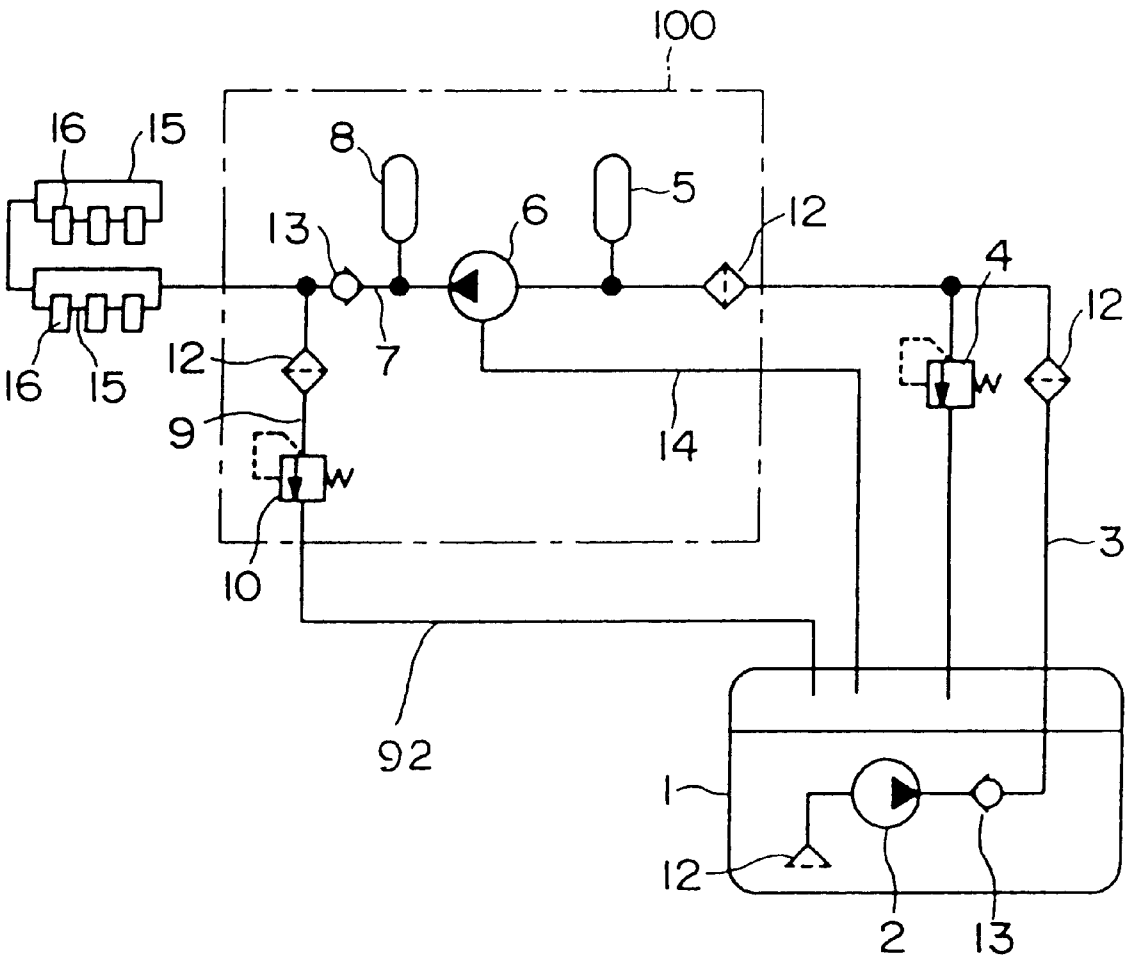
FIG. 6 PRIOR ART
FIG. 6 is a block diagram showing a construction of a conventional high-pressure fuel supply assembly.
Figure 7:
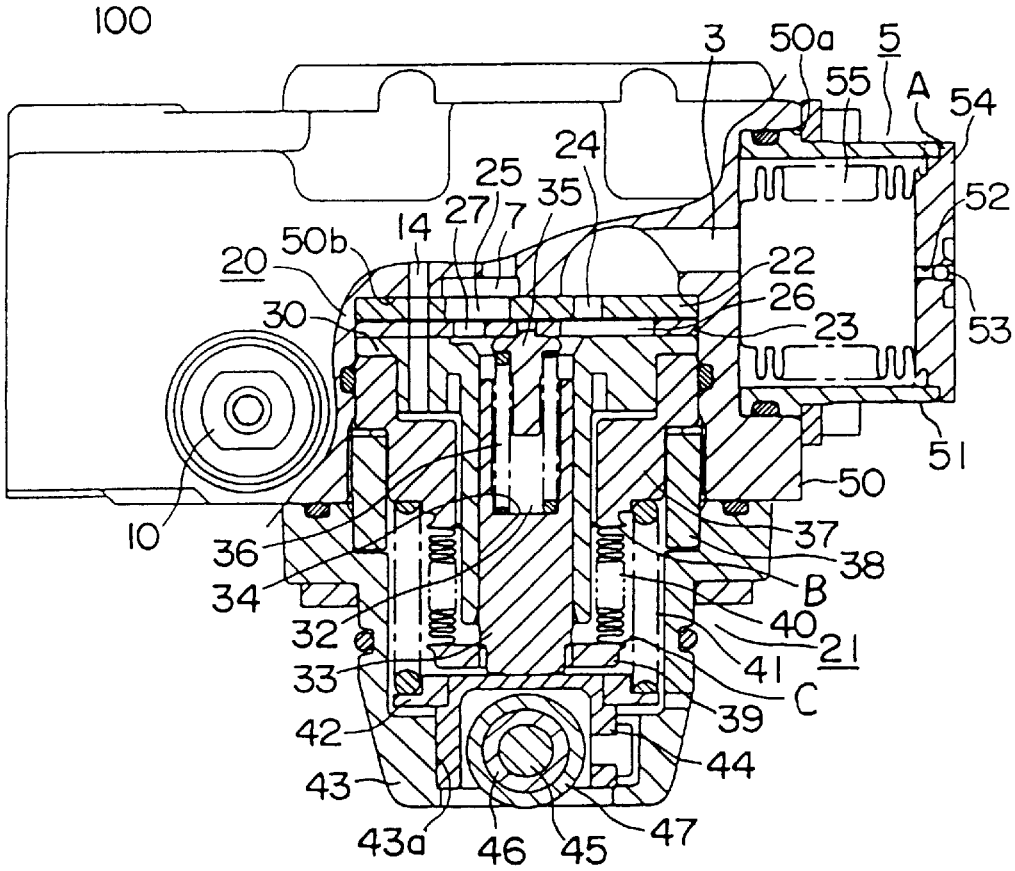
FIG. 7 PRIOR ART
FIG. 7 is a cross section of the high-pressure fuel supply assembly in FIG. 6.
Figure 8:
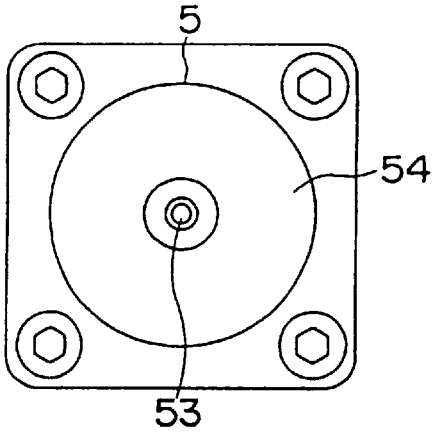
FIG. 8 PRIOR ART
FIG. 8 is a front elevation of the low-pressure damper in FIG. 7.
Figure 9:
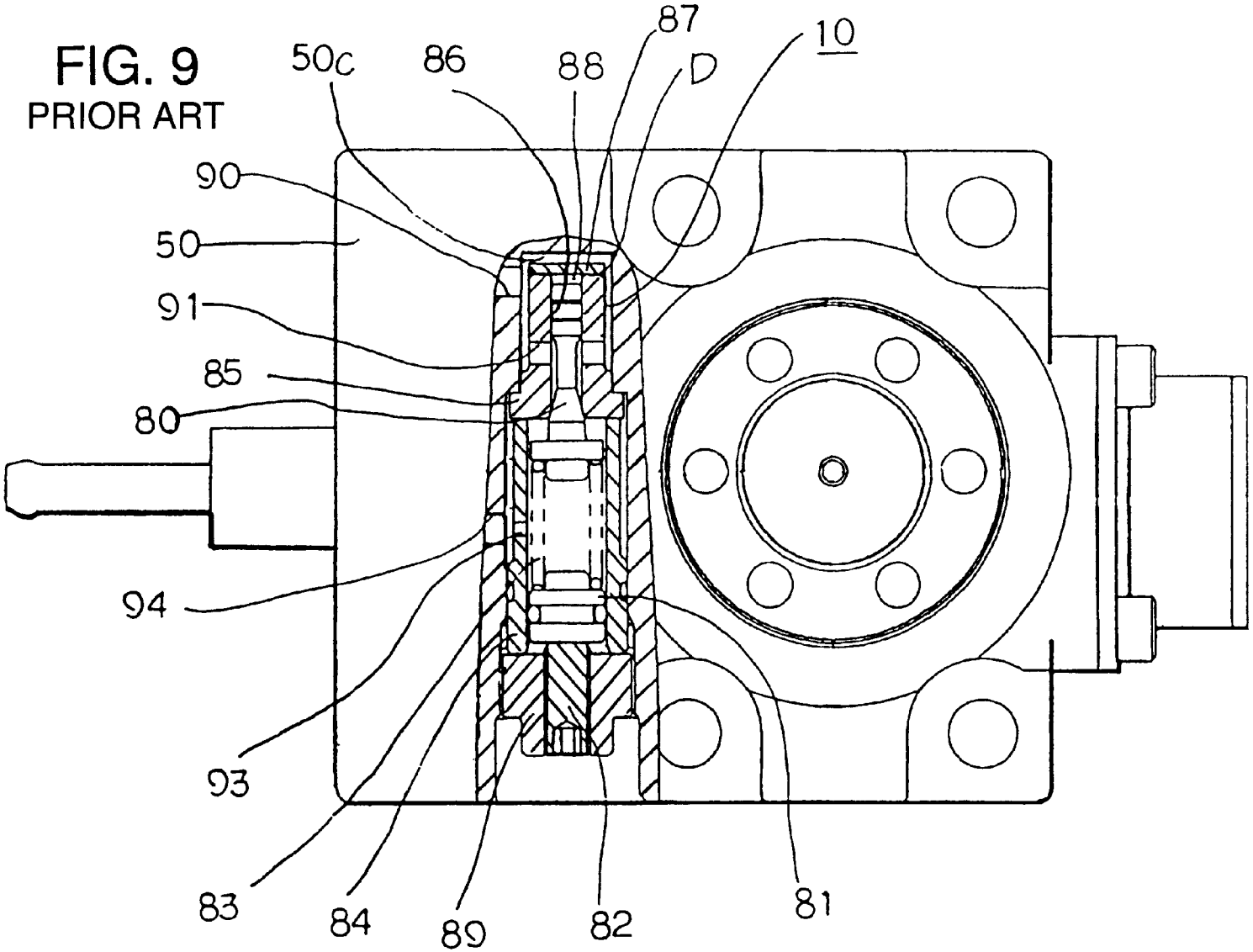
FIG. 9 PRIOR ART
FIG. 9 is a cross section of the high-pressure regulator in FIG. 7.
Figure 10:
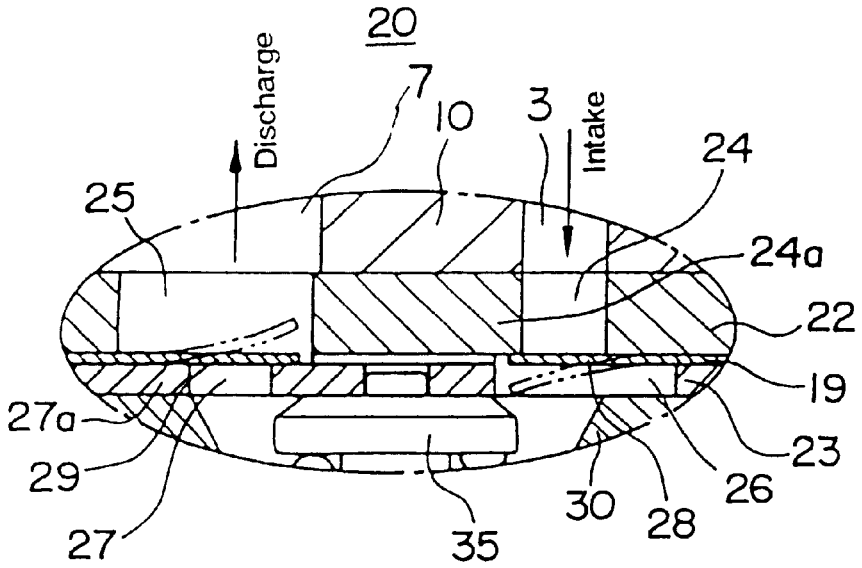
FIG. 10 PRIOR ART
FIG. 10 is a cross section of the valve assembly of the high-pressure fuel pump in FIG. 7.

FIG. 5 is an enlargement of the low-pressure damper weld portion A. Projections 116 projecting radially and extending circumferentially are formed at the low-pressure damper weld portion A. Because compressive forces generated in the projections 116 during thermal contraction of the weld act in the direction of the arrows F, cracks are less likely to occur in the weld portion A. Similarly, projections 116 are also formed in the high-pressure fuel pump weld portions B and C and the high-pressure regulator weld portion D, making the formation of cracks less likely in each, respectively.

Next, the appropriate volume ratio between stainless steel and low-carbon steel in the low-pressure damper weld portion A, the high-pressure fuel pump weld portions B and C, and the high-pressure regulator weld portion D will be explained.

Figure 3:
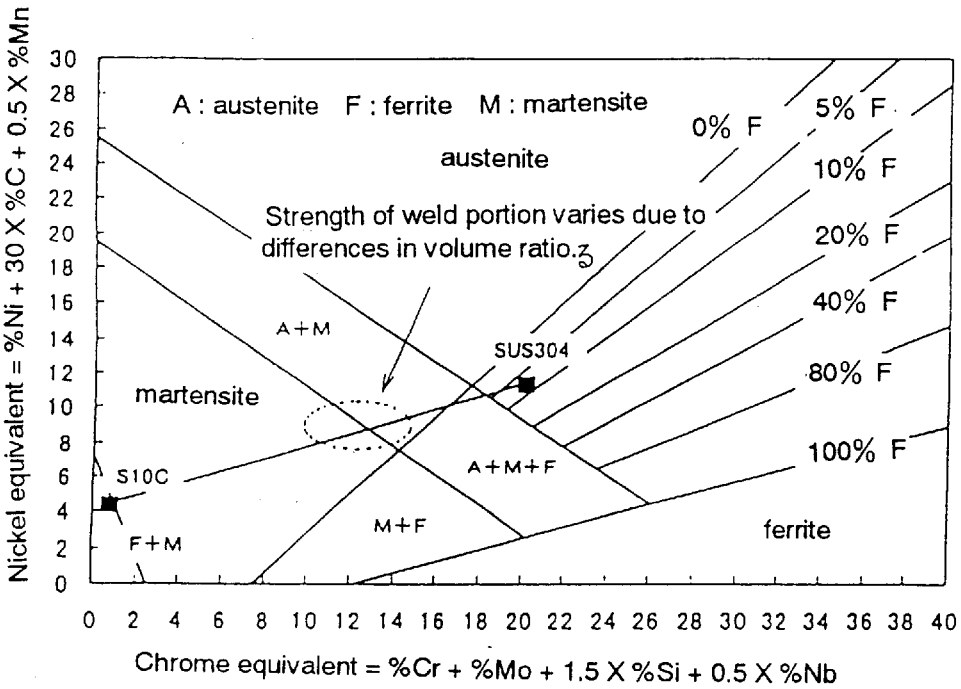
FIG. 3 is a Scheffler composition chart.
Figure 4:
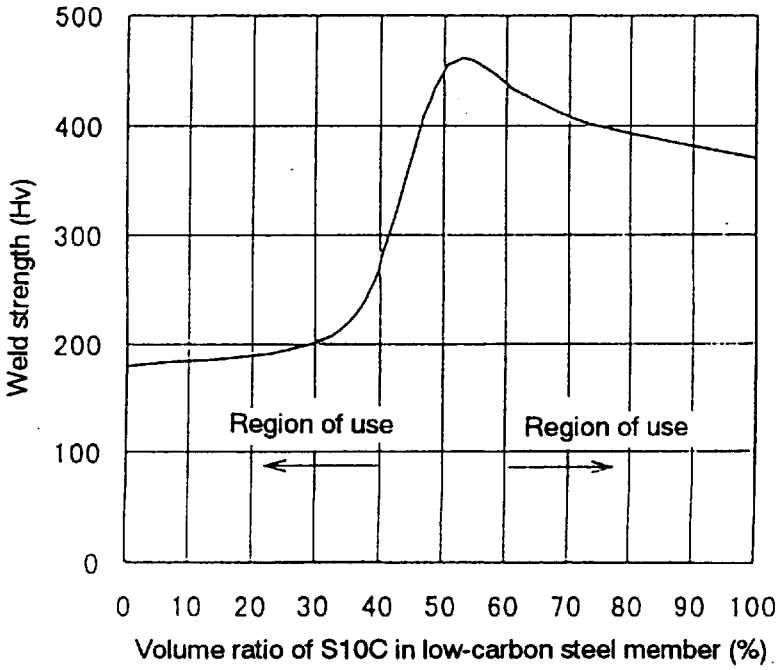
FIG. 4 is a graph showing the relationship between the volume ratio of low-carbon steel used and weld strength.
Figure 11:
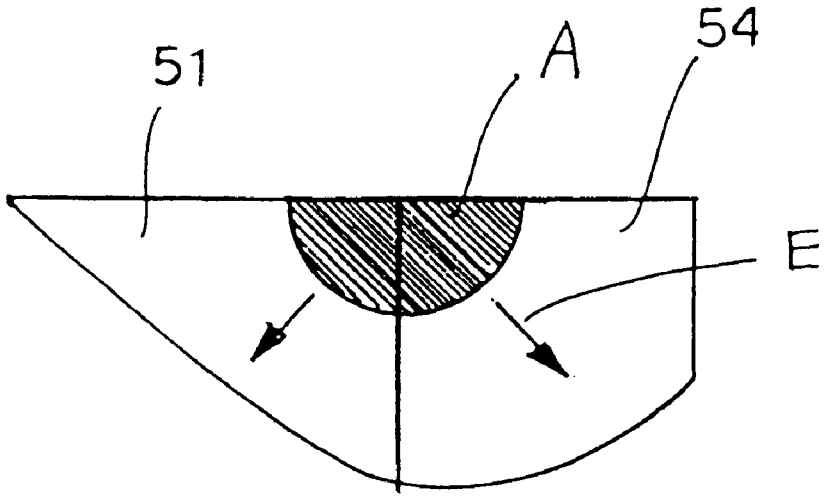
FIG. 11 PRIOR ART
FIG. 11 is a cross section of the low-pressure damper weld portion in FIG. 7.

FIG. 3 is a Scheffler composition chart, and FIG. 4 is a graph showing the relationship between the volume ratio of S10C, which is a low-carbon steel, to SUS304, which is an austenitic stainless steel, and the strength in each case. As can be seen from FIG. 4, when the volume ratio of S10C is 40 to 60 percent (the region surrounded by the dotted line in FIG. 3), the variation in strength corresponding to differences in volume ratio is great. Consequently, stable weld strength can be achieved if the volume ratio of S10C is set within a region where the variation in strength corresponding to differences in volume ratio is not great, in other words, in a range outside 40 to 60 percent.

Moreover, in the above embodiment, the low-pressure damper weld portion A is formed where the holder 60 and the base 54 contact each other, but the low-pressure damper weld portion A is not limited to this position. Similarly, the high-pressure fuel pump weld portions B and C are formed where the bellows 40 and the housing 61 or the bellows 40 and the receiving portion 62 contact each other, but the high-pressure fuel pump weld portions B and C are not limited to these positions. Again, the high-pressure regulator weld portion D is formed where the plate 87 and the sleeve 113 contact each other, but the high-pressure regulator weld portion D is not limited to this position.

Furthermore, in the above embodiment, weld portions are formed on the low-pressure damper, the high-pressure fuel pump, and the high-pressure regulator, respectively, but weld portions may also be formed on only one of or any combination of these.

Furthermore, the plating deposited by electroplating may be chrome plating, instead of nickel plating.

Furthermore, a stainless steel other than SUS304 may also be used. Moreover, a low-carbon steel other than S10C may also be used.

As explained above, the high-pressure fuel supply assembly according to one aspect of the present invention comprises the first member being composed stainless steel and the second member being composed of plated low-carbon steel in at least one weld portion among the low-pressure damper weld portion, the high-pressure fuel pump weld portion, and the high-pressure regulator weld portion. Therefore, the corrosion resistance of the second members can be ensured without using expensive stainless steel, improving workability during forging and reducing manufacturing costs significantly. Furthermore, corrosion resistance can be ensured in the weld portions.

According to one form of the high-pressure fuel supply assembly, the first member in the low-pressure damper weld portion may be a base forming a damper chamber when joined to a bellows; and the second member in the low-pressure damper weld portion may be a holder disposed surrounding the bellows. Therefore, the space between the holder and the base in the low-pressure damper weld portion is reliably sealed by the low-pressure damper weld portion.

According to another form of the high-pressure fuel supply assembly, the first member in the high-pressure fuel pump weld portion may be a bellows surrounding a sleeve in which a piston slides; and the second member in the high-pressure fuel pump weld portion may be a housing surrounding the sleeve. Therefore, the space between the bellows and the housing is reliably sealed by the high-pressure fuel pump weld portion.

According to still another form of the high-pressure fuel supply assembly, the first member in the high-pressure fuel pump weld portion may be a bellows surrounding a sleeve in which a piston slides; and the second member in the high-pressure fuel pump weld portion may be a receiving portion secured to an end portion of the piston. Therefore, the space between the bellows and the receiving portion is reliably sealed by the high-pressure fuel pump weld portion.

According to one form of the high-pressure fuel supply assembly, the second member in the high-pressure regulator weld portion may be a sleeve integrally disposed on an outer circumferential portion of a valve seat; and the first member in the high-pressure regulator weld portion may be a plate disposed on an end surface of the sleeve, the plate forming a volume chamber for damping a valve which slides inside the valve seat. Therefore, the space between the sleeve and the plate is reliably sealed by the high-pressure regulator weld portion.

According to another form of the high-pressure fuel supply assembly, a projection projecting radially and extending around a circumference may be formed on at least one weld portion among the low-pressure damper weld portion, the high-pressure fuel pump weld portion, and the high-pressure regulator weld portion. Therefore, compressive forces arise in the projections during the cooling of the weld, making it less likely that cracks will form in the weld portion, and thereby stabilizing weldability.

According to still another form of the high-pressure fuel supply assembly, the plating on the low-carbon steel may be nickel plating deposited by electroplating. Therefore, the corrosion resistance of the low-carbon steel is ensured and nickel fuses in the weld portion, austenite is formed during cooling, thus preventing cracks due to thermal contraction, thereby stabilizing the weld.

According to one form of the high-pressure fuel supply assembly, the plating on the low-carbon steel may be chrome plating deposited by electroplating. Therefore, the corrosion resistance of the low-carbon steel is ensured and chrome fuses in the weld portion, ferrite is formed during cooling, thus, preventing cracks due to thermal contraction, thereby stabilizing the weld.

According to another form of the high-pressure fuel supply assembly, the stainless steel may be SUS304; the low-carbon steel may be S10C; and the volume ratio of S10C in the low-pressure damper weld portion, the high-pressure fuel pump weld portion, and the high-pressure regulator weld portion may be in a range excluding 40 to 60 percent. Therefore, stable weld strength can be achieved.

What is claimed is:

1. A high-pressure fuel supply assembly comprising:

a low-pressure damper for absorbing surges in fuel flowing in from a fuel tank, said low-pressure damper including a low-pressure damper weld portion forming a seal between a first member and a second member which are contacted by said fuel;

a high-pressure fuel pump for pressurizing fuel from said low-pressure damper and discharging said fuel into a high-pressure fuel discharge passage, said high-pressure fuel pump being connected to said low-pressure damper by means of a low-pressure fuel intake passage, and said high-pressure fuel pump including a high-pressure fuel pump weld portion forming a seal between a third member and a fourth member which are contacted by said fuel; and a high-pressure regulator for adjusting the pressure of the high-pressure fuel from said high-pressure fuel pump to a predetermined pressure, said high-pressure regulator including a high-pressure regulator weld portion forming a seal between a fifth member and a sixth member which are contacted by said fuel, said first, third, and fifth members being composed of stainless steel and said second, fourth, and sixth member being composed of plated low-carbon steel in at least one weld portion among said low-pressure damper weld portion, said high-pressure fuel pump weld portion, and said high-pressure regulator weld portion.

2. The high-pressure fuel supply assembly according to claim 1 wherein:

said first member in said low-pressure damper weld portion is a base forming a damper chamber when joined to a bellows; and said second member in said low-pressure damper weld portion is a holder disposed surrounding said bellows.

3. The high-pressure fuel supply assembly according to claim 1 wherein:

said third member in said high-pressure fuel pump weld portion is a bellows surrounding a sleeve in which a piston slides; and said fourth member in said high-pressure fuel pump weld portion is a housing surrounding said sleeve.

4. The high-pressure fuel supply assembly according to claim 1 wherein:

said third member in said high-pressure fuel pump weld portion is a bellows surrounding a sleeve in which a piston slides; and said fourth member in said high-pressure fuel pump weld portion is a receiving portion secured to an end portion of said piston.

5. The high-pressure fuel supply assembly according to claim 1 wherein:

said sixth member in said high-pressure regulator weld portion is a sleeve integrally disposed on an outer circumferential portion of a valve seat; and said fifth member in said high-pressure regulator weld portion is a plate disposed on an end surface of said sleeve, said plate forming a volume chamber for damping a valve which slides inside said valve seat.

6. The high-pressure fuel supply assembly according to claim 1 wherein a projection projecting radially and extending around a circumference is formed on at least one weld portion among said low-pressure damper weld portion, said high-pressure fuel pump weld portion, and said high-pressure regulator weld portion.

7. The high-pressure fuel supply assembly according to claim 1 wherein said plating on said low-carbon steel is nickel plating deposited by electroplating.

8. The high-pressure fuel supply assembly according to claim 1 wherein said plating on said low-carbon steel is chrome plating deposited by electroplating.

9. The high-pressure fuel supply assembly according to claim 1 wherein:

said stainless steel is SUS304;

said low-carbon steel is S10C; and the volume ratio of S10C in said low-pressure damper weld portion, said high-pressure fuel pump weld portion, and said high-pressure regulator weld portion is in a range excluding 40 to 60 percent.

* * * * *